US007832165B2

(12) United States Patent
Randjelovic

(10) Patent No.: US 7,832,165 B2
(45) Date of Patent: Nov. 16, 2010

(54) POCKET ASSEMBLIES FOR SPORTS FLOORING SUB-FLOOR SYSTEMS

(75) Inventor: Erlin A. Randjelovic, Crystal Falls, MI (US)

(73) Assignee: Connor Sport Court International, Inc., Salt Lake City, UT (US)

( * ) Notice: Subject to any disclaimer, the term of this patent is extended or adjusted under 35 U.S.C. 154(b) by 0 days.

(21) Appl. No.: 12/388,312

(22) Filed: Feb. 18, 2009

(65) Prior Publication Data

US 2010/0205885 A1 Aug. 19, 2010

(51) Int. Cl.
*E04B 5/00* (2006.01)

(52) U.S. Cl. ..... 52/385; 52/506.06; 52/506.08; 52/512; 52/403.01; 52/480; 52/391

(58) Field of Classification Search ..... 52/480, 52/506.05, 506.06, 506.08, 512, 403.1, 384–385, 52/390–391, 464, 479, 489.1, 393, 368, 762, 52/763–765, 770, 772, 774, 778, 779
See application file for complete search history.

(56) References Cited

U.S. PATENT DOCUMENTS

| | | | | |
|---|---|---|---|---|
| 3,518,800 | A | 7/1970 | Tank | |
| 3,566,569 | A | 3/1971 | Coke et al. | |
| 4,856,250 | A | 8/1989 | Gronau et al. | |
| 4,879,857 | A | 11/1989 | Peterson et al. | |
| 5,016,413 | A * | 5/1991 | Counihan | 52/391 |
| 5,365,710 | A | 11/1994 | Randjelovic | |
| 6,164,031 | A * | 12/2000 | Counihan | 52/480 |
| 6,363,675 | B1 * | 4/2002 | Shelton | 52/403.1 |
| 6,637,169 | B2 * | 10/2003 | Niese et al. | 52/480 |
| 6,883,287 | B2 * | 4/2005 | Niese et al. | 52/403.1 |
| 7,121,052 | B2 * | 10/2006 | Niese et al. | 52/403.1 |
| 7,185,466 | B2 | 3/2007 | Randjelovic | |
| 2004/0040242 | A1 | 3/2004 | Randjelovic | |

* cited by examiner

*Primary Examiner*—Jeanette Chapman
(74) *Attorney, Agent, or Firm*—Greenberg Traurig, LLP; Mark R. Galis; Gary R. Jarosik

(57) ABSTRACT

A subfloor assembly for supporting a floor on a substrate includes a plurality of lower subfloor panels and a plurality of upper subfloor panels. The lower subfloor panels are resiliently disposed over the substrate while the upper subfloor panels are disposed over the lower subfloor panels. Each of the upper subfloor panels has at least one pocket and the pocket is disposed over a void that is provided between adjacent lower subfloor panels. An anchor is positioned in each pocket and is attached to the substrate. The anchor also engages a surface of a shoulder of at least one of the lower subfloor panels that is exposed under the pocket to thereby limit resilient upward movement of the subfloor assembly.

20 Claims, 4 Drawing Sheets

POCKET ASSEMBLIES FOR SPORTS FLOORING SUB-FLOOR SYSTEMS

TECHNICAL FIELD

The following generally relates sports flooring systems and, more particularly, relates to a resilient sub-floor assembly, used in the construction of sports flooring, which includes fabricated pockets for acceptance of strategically fixed steel channel sections.

BACKGROUND

Sports flooring systems offer various designs including rigid construction providing little or no resilience, as well as highly resilient shock absorbing cushioned floors. Numerous anchorage methods are known by which sports floor systems are attached to supporting substrates, which are most commonly concrete. Many sports flooring system designs also float freely with no anchorage attachment to a supporting substrate.

Examples of anchored sports flooring systems that provide little or no resiliency are exemplified in designs disclosed in U.S. Pat. No. 3,518,800 to Tank et al. and U.S. Pat. No. 3,566,569 to Coke et al. The Tank patent discloses a construction method wherein a steel channel is anchored to the supporting substrate and specially manufactured metal clips are used to secure flooring boards to steel channels. The Coke patent discloses a construction method wherein wooden nailing strips are anchored to the supporting substrate and flooring boards are attached to the nailing strips by stapling or nailing.

Designs disclosed in U.S. Pat No. 5,369,710 to Peterson et al. and U.S. Pat. No. 5,369,710 to Randjelovic et al. demonstrates widely used floating sports floor system construction. The designs disclosed in both of these patents include resilient components resting on a supporting substrate which in turn supports a wooden sub-floor and flooring surface.

Sub-floors constructed for sports floor applications are also provided in a manner combining anchorage to the rigid substrate, typically concrete, with included resiliency of elastic components such as those described in the Peterson and Randjelovic patents. Such construction is typically referred to, and known as, Fixed Resilient sports floor systems. U.S. Pat. No. 5,016,413 to Counihan et al. discloses a Fixed Resilient design including a wooden panel sub-floor supported by resilient components and a means to restrain the flooring system by incorporating steel channels attached to the supporting substrate.

U.S. Pat. No. 4,856,250 to Gronau et al. and U.S. Pat. No. 7,185,466 et al. to Randjelovic further demonstrates designs incorporating various wooden sub-floor and resilient components. These three referenced patents illustrate various methods to provide flooring systems with stability by means of substrate attachment while also providing resilient components for desired shock absorbency.

These referenced patents and designs, which are incorporated herein by reference in their entirety, are examples of the known range of sub-floor constructions available and in use in the sports floor industry.

SUMMARY

As demonstrated in the following descriptions, the present invention provides a unique means to assemble special upper sub-floor panel sections in combination with strategically placed lower sub-floor panel sections to soundly integrate sub-floor layers prior to placement of flooring surface material. This assembly is shown as a manner to include isolated sub-floor pockets to incorporate desired double flange channel sections for attachment to a supporting substrate.

By way of example, such a subfloor assembly includes a plurality of lower subfloor panels and a plurality of upper subfloor panels. The lower subfloor panels are resiliently disposed over a substrate while the upper subfloor panels are disposed over the lower subfloor panels. Each of the upper subfloor panels has at least one pocket and the pocket is disposed over a void that is provided between adjacent lower subfloor panels. An anchor is positioned in each pocket and is attached to the substrate. The anchor also engages a surface of a shoulder of at least one of the lower subfloor panels that is exposed under the pocket to thereby limit resilient upward movement of the subfloor assembly.

While the foregoing generally describes an exemplary embodiment of the subject sub-floor assembly and various advantages achieved thereby, a better understanding of the objects, advantages, features, properties, and relationships of the invention will be obtained from the following detailed description and accompanying drawings which set forth illustrative embodiments which are indicative of the various ways in which the principles of the invention may be employed.

BRIEF DESCRIPTION OF THE DRAWINGS

For a better understanding of the invention reference may be made to preferred embodiments shown in the following drawings in which.

DETAILED DESCRIPTION

Figure 1:
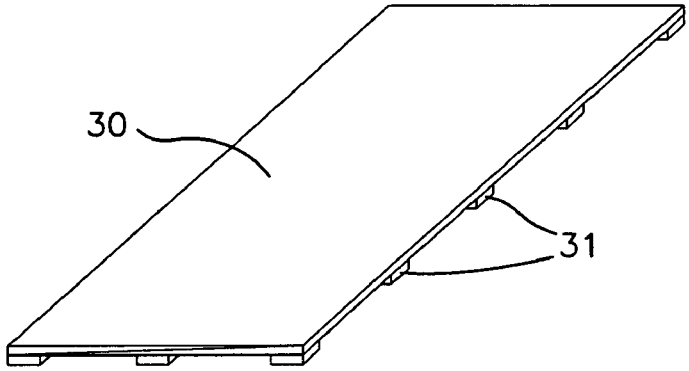
FIG. 1 is a perspective top view of a lower sub-floor panel section made according to the present invention.

Preferred embodiments of the invention will be described in detail with reference to the figures, wherein like reference numerals represent like parts and assemblies throughout the several views.

In general, the present invention relates to a sub-floor for placement below an upper flooring surface generally used for athletic activities which together form a sports floor.

Referring first to FIG. 1, which is a top perspective view of a lower sub-floor panel 30 which is desirably manufactured from plywood sheathing in a most preferred 23¼" wide and 96" long dimension. While the lower sub-floor panel 30 is shown having a preferred rectangular shape and described dimensions it will be appreciated that the lower sub-floor panel 30 may be provided with an alternate square shape in various dimensions or rectangular shape in alternate dimensions. It will also be appreciated that the lower sub-floor panel 30 can be manufactured from alternate materials such as oriented strand board, particle board, and other sound and suitable material. Although not having a defined thickness, lower sub-floor panels 30 are preferably manufactured from nominal ⅜" to ¾" thick panels.

The lower sub-floor panel 30 is most typically supported by the attachment of resilient pads 31 by most common means of mechanical stapling or the use of suitable adhesive. While resilient pads 31 illustrated in FIG. 1 are shown in a flat rectangular dimension as commonly included in resilient sports floor assemblies, it will be appreciated that resilient pads are offered in many different shapes (e.g., conical, triangular, hemispherical) and various materials (e.g., synthetic rubber, vinyl, natural rubber, urethane) and can be equally used in sports floor assemblies. The spacing of resilient pads 31 along underside of lower sub-floor panel 30 can be adjusted to achieve desired performance characteristics for athletic use.

Figure 2:
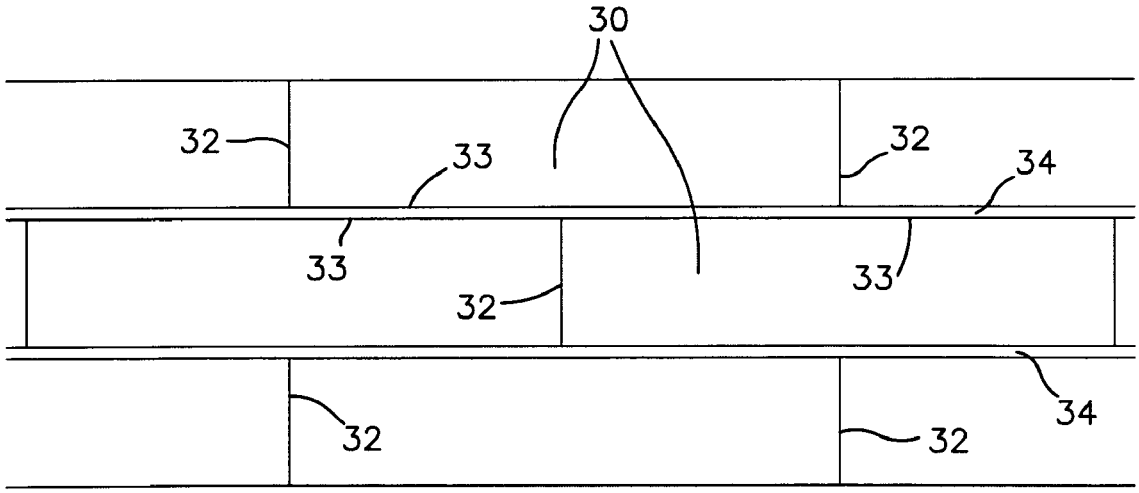
FIG. 2 is a top view of a series of lower sub-floor panels as illustrated in FIG. 1 and arranged in the most preferred alignment.

FIG. 2 shows the top view of a series of lower sub-floor panel 30 rows, manufactured in 96" lengths, and arranged in a typical manner during installation. Lower sub-floor panel end joints 32 are preferably offset by 48" from lower sub-floor panel end joints 32 in adjacent rows. Lower sub-floor panel side joints 33 are separated to provide lower sub-floor voids 34 preferably measuring nominal 1½".

Figure 3:
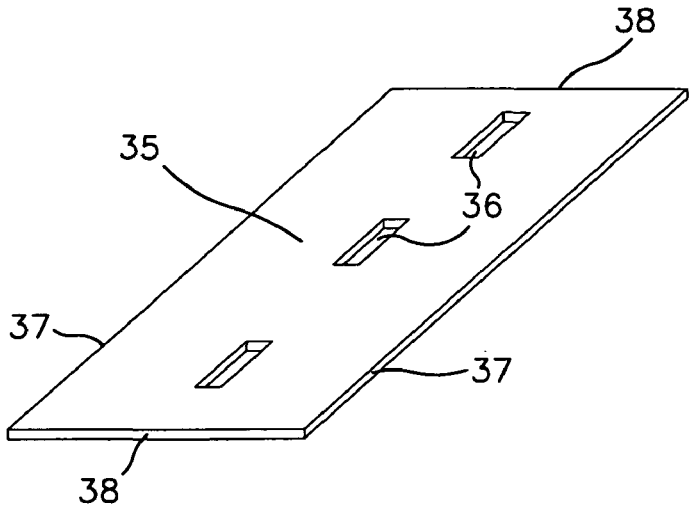
FIG. 3 is a top perspective view of an upper sub-floor panel section made according to the present invention.

FIG. 3 is a top perspective view of an upper sub-floor panel 35 which is desirably manufactured from plywood sheathing in a most preferred 24½" wide and 96" long dimension. While the upper sub-floor panel 35 is shown having a preferred rectangular shape and described dimensions it will be appreciated that an alternate square shape in various dimensions or rectangular shape in alternate dimensions can be used. It is also to be appreciated that the upper sub-floor panel 35 can be manufactured from alternate materials such as oriented strand board, particle board, and other sound and suitable material. Although not having a defined thickness, upper sub-floor panels 35 are preferably manufactured from nominal ⅜" to ¾" thick panels.

Figure 4:
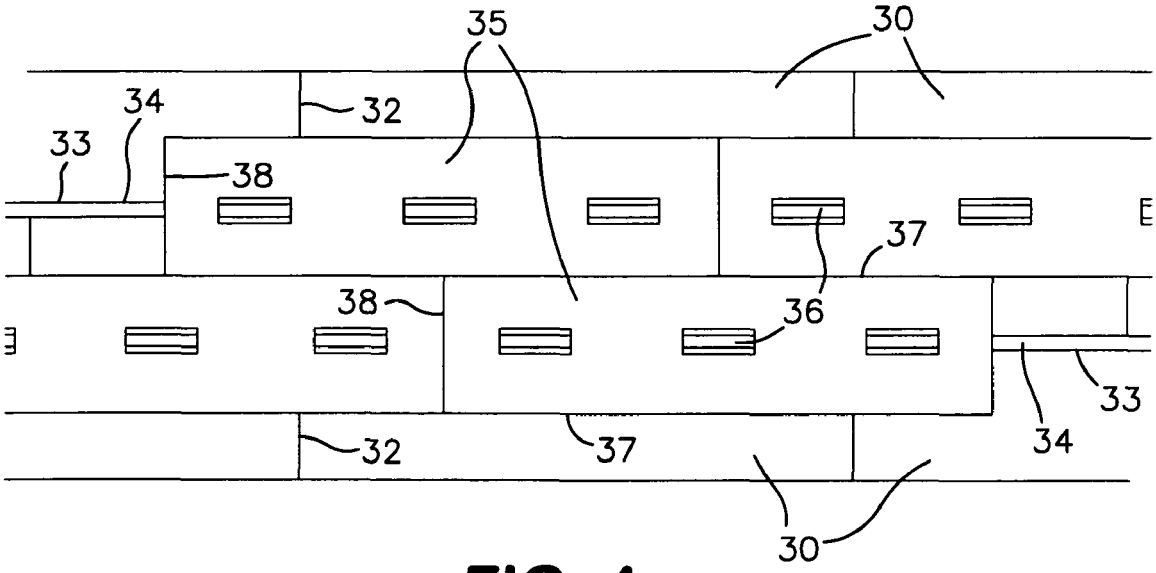
FIG. 4 is a top view of a series of upper sub-floor panels as illustrated in FIG. 3 and placed in preferred alignment over lower sub-floor panels as illustrated in FIG. 2.

As further seen in FIGS. 3 and 4, a series of upper sub-floor anchor pockets 36, e.g., a series of three, are shown as included in each upper sub-floor panel 35. The most preferred dimension of the upper sub-floor anchor pockets 36 is 3" in width and 12" in length, but need not be limited to this dimension. The upper sub-floor anchor pockets 36 are preferred to be located down the center of the upper sub-floor panel 35 while being arranged parallel to the upper sub-floor panel side edges 37. The most desired spacing between upper sub-floor anchor pockets 36 is 32" on center with the two end pockets aligned 16" on center from the upper sub-floor end edges 38. As will be understood, alternate dimensions and alignments as well as the number of upper sub-floor anchor pockets 36 can be used.

FIG. 4 is a top view of a series of upper sub-floor panels 35 in typical placement over lower subfloor panels 30. Upper subfloor panel end edges 38 are preferably offset 48" from upper sub-floor panels end edges 38 in adjacent rows. Upper sub-floor panel end edges 38 are also preferably offset by 24" from lower sub-floor panel end edges 32. Upper sub-floor panel side edges 37 are offset from lower sub-floor panel side edges 33 in a manner which aligns the center of the upper sub-floor anchor pockets 36 over lower subfloor voids 34. Upper sub-floor panels 35 are most typically secured to lower sub-floor panels 30 by means of mechanical fastening such as stapling, but can be attached by other means such as suitable wood screws or adhesive.

Figure 5:
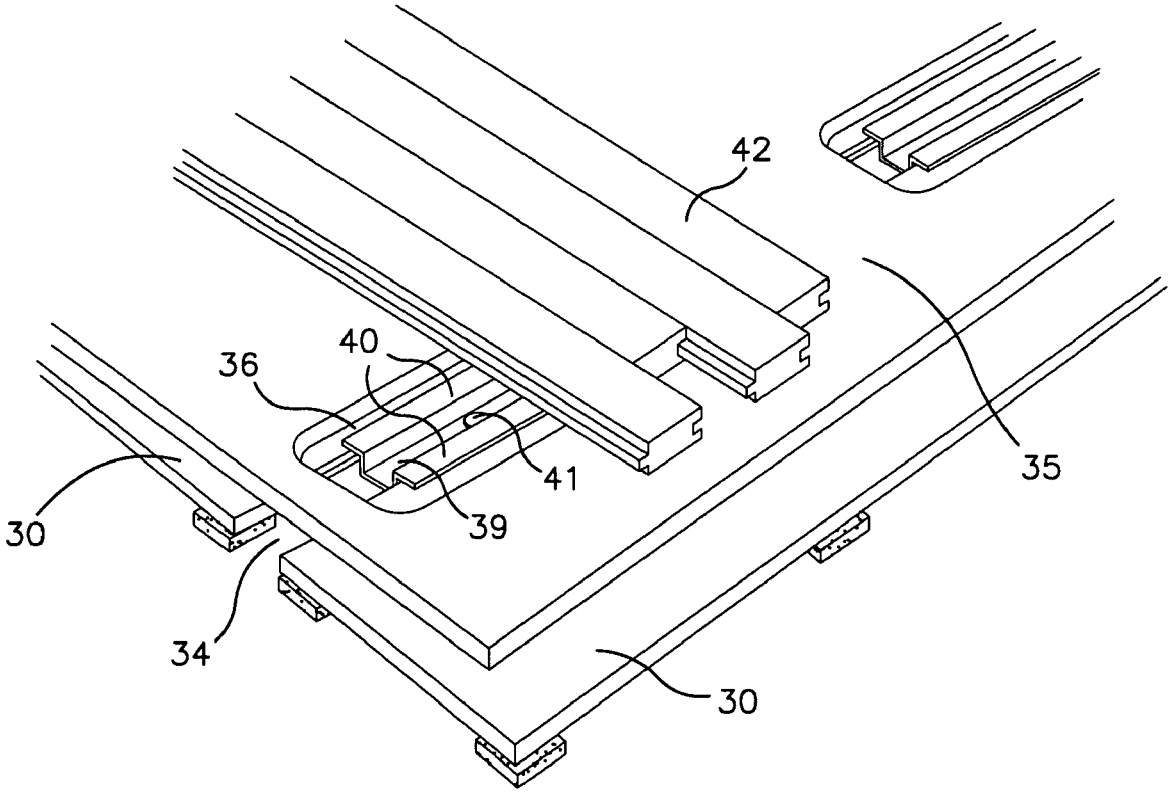
FIG. 5 is a top perspective view of an anchor pocket formed through strategic placement of upper and lower sub-floor panels according to the present invention.

FIG. 5 is a perspective top view of an anchorage location formed by alignment of an anchor pocket 36 of an upper sub-floor panel 35 and a lower sub-floor void 34 between lower sub-floor panels 30. A steel sectional channel 39 is positioned within the anchor pocket 36 which, as illustrated in the figure, is preferred to have a width that is wider than the void 34 over which it is disposed. The steel channel section 39 preferably measures 10" in length, but can be dimensioned in any suitable length. The steel channel section 39 is formed in a shape commonly referred to as hat channel which includes two upper flanges 40. The wall height of the steel channel section 39 is such that the upper flanges 40 rest firmly on the surface of shoulders formed along the edges of the lower sub-floor panels 30. The steel channel section 39 is fastened to the supporting substrate, which is most typically concrete, by means of an anchorage pin 41 especially suited for connection to the substrate material. The most preferred flooring surface 42 is shown in the form of commonly installed tongue and groove flooring material often provided in sports floor applications. This type of flooring surface 42 is attached to the sub-floor by typical means of mechanical fastening or adhesive.

Figure 6:
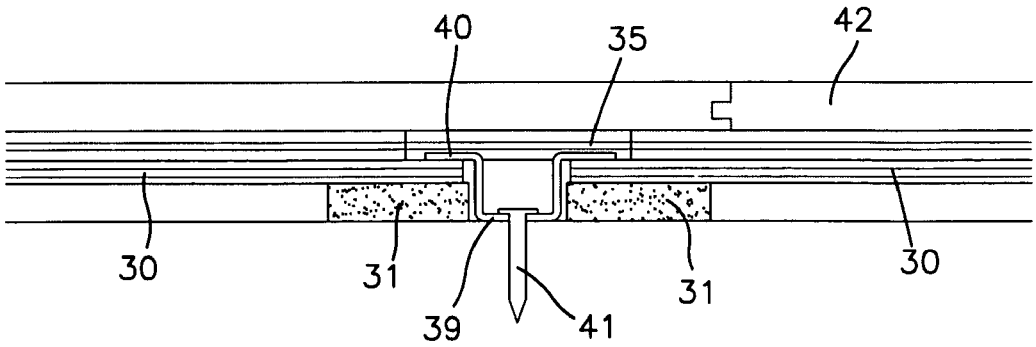
FIG. 6 is an end view of the invention with the inclusion of a typically applied upper floor surface.

FIG. 6 is an end view of the invention with the inclusion of a top flooring surface 42 which is supported by an upper sub-floor panel 35. The end view of a steel channel section 39 is shown with upper flanges 40 resting on the exposed shoulders of lower sub-floor panels 30 which are supported by resilient pads 31 to thereby limit upward movement of the subfloor assembly. The steel channel section 39 is fastened to the substrate by an anchorage pin 41.

Figure 7:
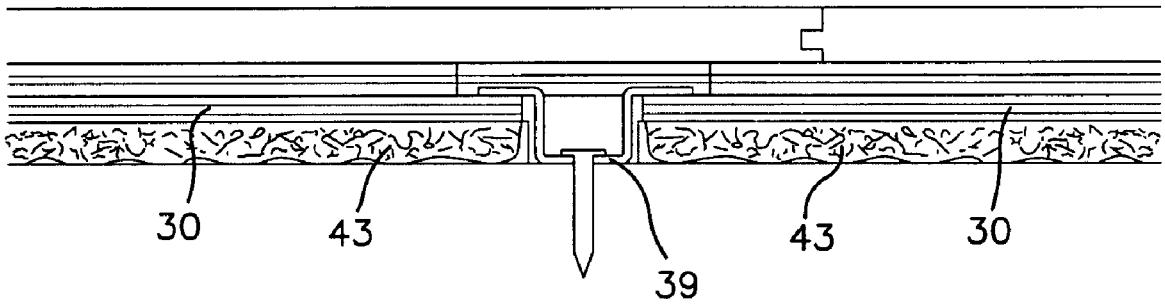
FIG. 7 is an end view of the invention including an alternate resilient material placed below the sub-floor.

FIG. 7 is an end view of the invention showing the inclusion of an alternate resilient component provided by placement of foam blanket sections 43 aligned along each outside edge of the steel channel section 39. Lower sub-floor panels 30 are shown as resting fully on foam blanket sections 43 which are desirably nominally the same width as the lower sub-floor panels 30.

While specific embodiments of the invention have been described in detail, it will be appreciated by those skilled in the art that various modifications and alternatives to those details, such as those highlighted above and provided by way of example only, could be developed in light of the overall teachings of the disclosure. Accordingly, the particular arrangements disclosed are meant to be illustrative only and not limiting as to the scope of the invention which is to be given the full breadth of the appended claims and any equivalents thereof.

What is claimed is:

1. A subfloor assembly for supporting a floor on a substrate, the subfloor assembly comprising:

a plurality of lower subfloor panels resiliently disposed over the substrate;

a plurality of upper subfloor panels disposed over the plurality of lower subfloor panels, wherein at least one pocket is formed within an interior of each of the plurality of upper subfloor panels whereby the pocket has sides that are defined only by a respective one of the plurality of upper subfloor panels in which the pocket is formed and wherein the pocket of each of the plurality of upper subfloor panels is disposed over a void that is formed between at least two adjacent ones of the plurality of lower subfloor panels such that a portion of a shoulder of at least one of the two adjacent ones of the plurality of lower subfloor panels is exposed under the pocket; and an anchor positioned in each pocket attached to the substrate and engaging a surface of the portion of the shoulder of the at least one of the two adjacent ones of the plurality of lower subfloor panels that is exposed under the pocket to thereby limit resilient upward movement of the subfloor assembly.

2. The subfloor assembly as recited in claim 1, wherein a portion of a shoulder of each of the two adjacent ones of the plurality of lower subfloor panels is exposed under each of the pockets and the anchor positioned in each pocket engages a surface of the portion of the shoulder of each of the two adjacent ones of the plurality of lower subfloor panels that is exposed under the pocket to thereby limit resilient upward movement of the subfloor assembly.

3. The subfloor assembly as recited in claim 2, wherein the anchor is formed in the shape of a hat channel.

4. The subfloor assembly as recited in claim 1, comprising resilient pads disposed between the plurality of lower subfloor panels and the substrate.

5. The subfloor assembly as recited in claim 1, comprising a resilient blanket disposed between the plurality of lower subfloor panels and the substrate.

6. The subfloor assembly as recited in claim 1, wherein the plurality of lower subfloor panels are arranged into a plurality of rows and wherein adjacent ones of the plurality of lower subfloor panels in adjacent ones of the plurality of rows are separated by the void.

7. The subfloor assembly as recited in claim 1, wherein a plurality of spaced apart pockets are formed within the interior of each of the plurality of upper subfloor panels.

8. The subfloor assembly as recited in claim 7, wherein the plurality of pockets formed in each of the plurality of upper subfloor panels are arranged parallel to a side of the respective one of the plurality of upper subfloor panels in which the plurality of pockets are formed.

9. The subfloor assembly as recited in claim 8, wherein the plurality of pockets formed in each of the plurality of upper subfloor panels are centered within the interior of the respective one of the plurality of upper subfloor panels in which the plurality of pockets are formed.

10. The subfloor assembly as recited in claim 1, wherein the plurality of upper subfloor panels are attached to the plurality of lower subfloor panels.

11. A sports flooring assembly, comprising:

a plurality of lower subfloor panels resiliently disposed over a substrate;

a plurality of upper subfloor panels disposed over the plurality of lower subfloor panels, wherein at least one pocket is formed within an interior of each of the plurality of upper subfloor panels whereby each pocket has sides that are defined only by the respective one of the plurality of upper subfloor panel in which the pocket is formed and wherein the pocket of each of the plurality of upper subfloor panels is disposed over a void that is formed between at least two adjacent ones of the plurality of lower subfloor panels such that a portion of a shoulder of at least one of the two adjacent ones of the plurality of lower subfloor panels is exposed under the pocket;

a plurality of sports floor panels attached to the plurality of upper subfloor panels; and an anchor positioned in each pocket attached to the substrate and engaging a surface of the portion of the shoulder of the at least one of the two adjacent ones of the plurality of lower subfloor panels that is exposed under the pocket to thereby limit resilient upward movement of the subfloor assembly.

12. The sports flooring assembly as recited in claim 11, wherein a portion of a shoulder of each of the two adjacent ones of the plurality of lower subfloor panels is exposed under each of the pockets and the anchor positioned in each pocket engages a surface of the portion of the shoulder of each of the two adjacent ones of the plurality of lower subfloor panels that is exposed under the pocket to thereby limit resilient upward movement of the upper and lower subfloor panels.

13. The sports flooring assembly as recited in claim 12, wherein the anchor is formed in the shape of a hat channel.

14. The sports flooring assembly as recited in claim 11, comprising resilient pads disposed between the plurality of lower subfloor panels and the substrate.

15. The sports flooring assembly as recited in claim 11, comprising a resilient blanket disposed between the plurality of lower subfloor panels and the substrate.

16. The sports flooring assembly as recited in claim 11, wherein the plurality of lower subfloor panels are arranged into a plurality of rows and wherein adjacent ones of the plurality of lower subfloor panels in adjacent ones of the plurality of rows are separated by the void.

17. The sports flooring assembly as recited in claim 11, wherein a plurality of spaced apart pockets are formed within the interior of each of the plurality of upper subfloor panels.

18. The sports flooring assembly as recited in claim 17, wherein the plurality of pockets formed in each of the upper subfloor panels are arranged parallel to a side of the respective one of the plurality of upper subfloor panels in which the plurality of pockets are formed.

19. The sports flooring assembly as recited in claim 18, wherein the plurality of pockets formed in each of the upper subfloor panels are centered within the interior of the respective one of the plurality of upper subfloor panels in which the plurality of pockets are formed.

20. The sports flooring assembly as recited in claim 11, wherein the plurality of upper subfloor panels are attached to the plurality of lower subfloor panels.

* * * * *